US006585439B2

(12) United States Patent
Johnson et al.

(10) Patent No.: US 6,585,439 B2
(45) Date of Patent: Jul. 1, 2003

(54) PRINTER MEDIA ALIGNMENT APPARATUS AND METHOD

(75) Inventors: Bruce G. Johnson, Boise, ID (US); Antonio Gomez, Vancouver, WA (US); Richard A. Kelley, Vancouver, WA (US); Michael W. Munro, Vancouver, WA (US); Richard Olson, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 152 days.

(21) Appl. No.: 09/737,709

(22) Filed: Dec. 15, 2000

(65) Prior Publication Data

US 2002/0076250 A1 Jun. 20, 2002

(51) Int. Cl.[7] ..... B41J 13/10; B41J 11/10; B41J 11/58; B41J 13/02

(52) U.S. Cl. ..... 400/642; 400/579; 400/632; 400/632.1; 400/633.1; 400/637; 400/642; 400/630

(58) Field of Search ..... 400/579, 642, 400/631, 632, 630, 637, 632.1, 633.2, 633.1

(56) References Cited

U.S. PATENT DOCUMENTS

| | | | | | |
|---|---|---|---|---|---|
| 5,100,125 | A | * | 3/1992 | Uplinger et al. | 271/233 |
| 5,445,369 | A | * | 8/1995 | Golicz et al. | 271/3.23 |
| 5,642,952 | A | * | 7/1997 | Tomatsu et al. | 400/624 |
| 5,961,224 | A | * | 10/1999 | Baitz et al. | 400/56 |
| 6,042,283 | A | * | 3/2000 | Koyabu et al. | 400/605 |

* cited by examiner

*Primary Examiner*—Stephen R. Funk
*Assistant Examiner*—Marvin P Crenshaw

(57) ABSTRACT

A printer having a media transport mechanism defining a media path. The path extends from a media supply past a print engine. A media alignment element moves between an extended position intersecting the path between the supply and the engine, and a retracted position away from the path. The printer may include a pair of rollers between the supply and the alignment element and encompassing the path, so that the sheet may be gripped by the rollers at a position adjacent the alignment to preserve the alignment by the element. The rollers may retract the sheet from the alignment element, which may move aside from the media path, so that the media may be fed toward a print engine.

38 Claims, 4 Drawing Sheets

FIG. 2
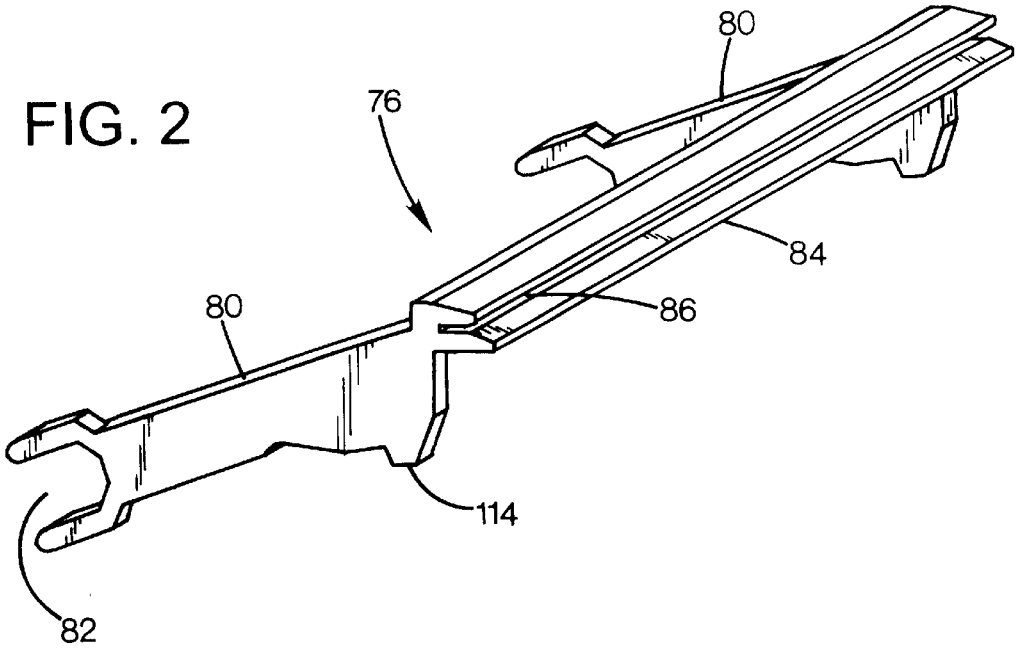
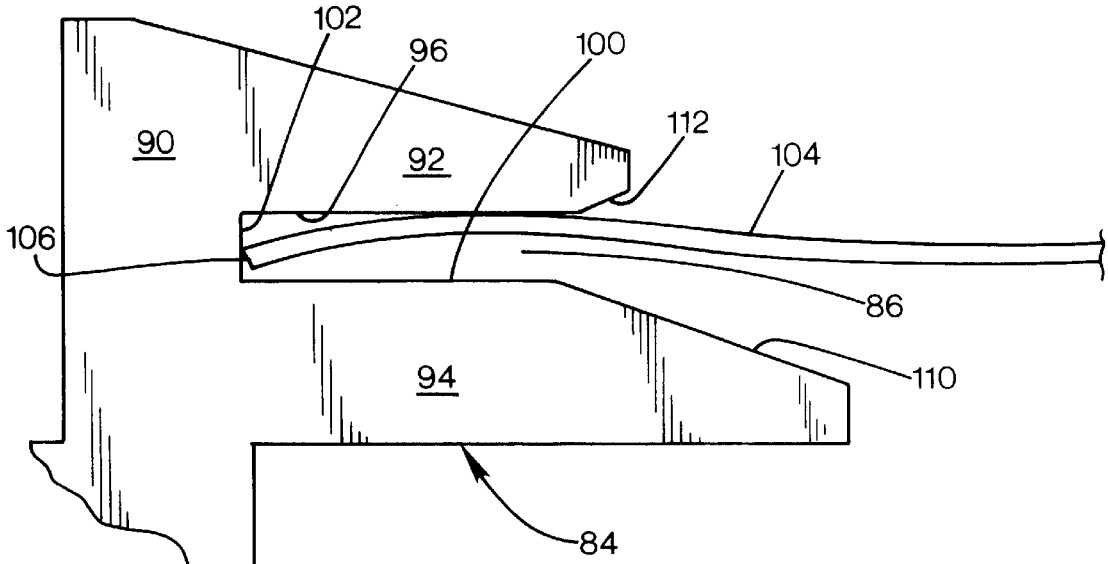
FIG. 3

PRINTER MEDIA ALIGNMENT APPARATUS AND METHOD

FIELD OF THE INVENTION

This invention relates to computer printers, and particularly to media transport mechanisms and methods of aligning media sheets for printing.

BACKGROUND AND SUMMARY OF THE INVENTION

For accurate printing, it is important to align the print media with a print engine that will generate an image on the media. Any skew of the media will lead to an apparent skew of printing on the resulting printed sheet. Accordingly, printers have employed various techniques for "de-skewing" media after it is drawn from a stack or supply, and before printing.

One de-skewing technique is to advance the leading edge of a sheet against the nip of a pair of stationary and closed rollers, so that the groove defined by the rollers tends to trap the sheet edge. If one corner of the leading edge reaches the groove early, due to a skew, it is trapped in the groove as the other corner proceeds into the groove. Then, the sheet is advanced by rotating the rollers, and the sheet maintains the alignment provided by the process.

While effective for many applications, this approach still permits some degree of skew error. The elastomeric rollers required for effective transport of the sheet tend to catch the sheet edge, so that both corners do not necessarily fully lodge deep in the groove; one corner may stop slightly prematurely due to the friction involved. Other de-skewing techniques are considered to be disadvantageous due to the cost or bulk required for their mechanisms, or the delay introduced into a printing process where throughput rate can be important.

The present invention overcomes the limitations of the prior art by providing a printer having a media transport mechanism defining a media path. The path extends from a media supply past a print engine. A media alignment element moves between an extended position intersecting the path between the supply and the engine, and a retracted position away from the path. The printer may include a pair of rollers between the supply and the alignment element and encompassing the path, so that the sheet may be gripped by the rollers at a position adjacent the alignment to preserve the alignment by the element. The rollers may retract the sheet from the alignment element, which may move aside from the media path, so that the media may be fed toward a print engine.

BRIEF DESCRIPTION OF THE DRAWINGS

FIG. 2 is a perspective view of an alignment element according to the embodiment of FIG. 1.

FIG. 3 is an enlarged side view of an alignment element according to the embodiment of FIG. 1.

DETAILED DESCRIPTION OF A PREFERRED EMBODIMENT

Figure 1:
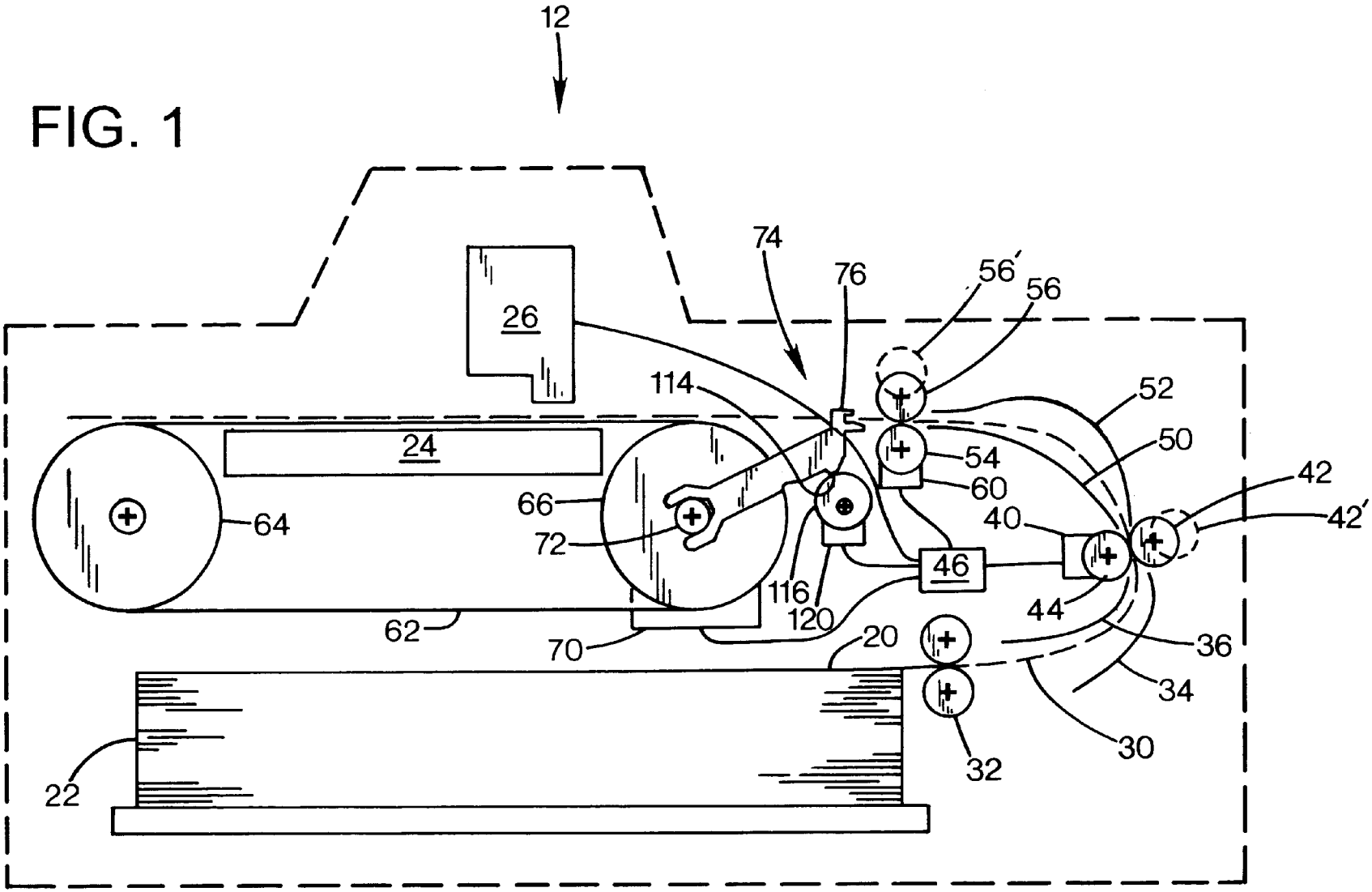
FIG. 1 is a simplified sectional side view of a printing system according to a preferred embodiment of the invention.

FIG. 1 shows an ink jet printer 12 that operates by drawing a sheet of media 20 from a stack 22, and transporting it over a platen 24 beneath an ink jet pen 26, which reciprocates over the sheet to generate successive swaths of an image as the sheet is incremented or indexed along a media path 30.

The sheet is motivated along the paper path initially by a pick system (details omitted) that includes a first feed roller pair 32. The media path proceeds past the first pair into a throat defined by a pair of curved guides 34, 36 that define an upwardly curved path that leads into a second pair of feed rollers 40, 42 that normally are closed to define a nip. At least one of the rollers 40 is motorized by a motor 44 connected to a printer controller 46. The other roller 42 is movable away from the roller 40 to an open position 42' to form a gap with roller 40.

The media path proceeds upward, between two curved guides 50, 52, that form a chamber which is tapered at the rollers 40, 42, and which tapers down to approach a third pair of rollers 54, 56. The guide 52 does not need to be continuous across the entire width of a sheet, and may need to be split to allow for accessory feeders or a multi-purpose tray to feed media into the paper path. The outer guide 52 provides a primarily concave surface with convex end portions, and the inner guide 50 provides a convex surface. The roller 54 is driven by a reversing motor 60 that is controlled by the controller 46, and the other roller 56 is movable between a closed position shown in solid lines to define a nip with roller 54, and an open position 56' to define a gap with roller 54. The nips of roller pair 42, 44, and roller pair 54, 56 each define nip planes, and these nip planes are angularly offset from each other. This provides a bend in a sheet passing through both pairs, so that lengthwise compression of the sheet will lead to further bending or buckling without an appreciable initial force, as tends to occur when buckling a sheet from a straight position.

The media path proceeds onto the surface of a belt 62 that is tautly supported by a pair of belt rollers 64, 66, so that an upper span of the belt overlays the platen 24, beneath the ink jet pen 26. Alternative printer embodiments may use transport alternatives to the belt drive such as are well known in the field. A belt drive motor 70 drives roller 66, which rotates on a datum axle shaft 72. The datum shaft is important for dimensional precision of the printer function. The pen carriage mechanism is registered to the shaft, as are the belt to which print media is fixed during printing, and the sheet alignment mechanism to be discussed below. In the preferred embodiment, the carriage mechanism is registered to the side plates and the side plates are registered the shaft. However, registering the carriage directly to the shaft would provide added alignment precision in alternative embodiments where this is needed.

A media alignment or de-skew mechanism 74 includes an alignment element 76, shown in detail in FIG. 2. The alignment element includes a pair of arms 80. Each arm has a first free end defining a notch 82 that tightly receives one end of the datum shaft 72. This serves as a pivot point for the element. The arms are spaced apart to accommodate the roller 66 and belt 62, and are joined by an elongated rail 84 that extends between ends of the arms opposite the free ends. When installed, the rail and all its features are held parallel to the datum shaft, regardless of the angular position of the rail due to pivoting about the shaft.

As shown in FIG. 3, the rail 84 has a U-shaped cross section consistent along its length, defining a deep, narrow channel or groove 86 defined by a base 90, an upper wall 92, and a lower wall 94. The groove has an upper wall surface 96, and a parallel opposed lower wall surface 100 spaced apart by a limited distance, small enough to limit leading edge buckling but large enough to allow the media to readily enter the groove. The groove has a flat floor surface 102 perpendicular to the wall surfaces. The wall surfaces are preferably wider than the floor surface, so that the groove has a depth ratio adequate to constrain a sheet 104 to limit flexing or buckling, when the leading edge 106 of the sheet is against the floor surface. Each wall has a tapered surface 110, 112 that assists in guiding the leading edge into the groove. The upper wall 92 is shorter than the lower wall, providing the clearance needed for pivoting past roller 54 while still minimizing the distance between the groove and the roller.

Returning to FIG. 1, a cam follower protrusion 114 extends downward from each arm of the element, and rests on an eccentric cam 116 driven by a motor 120 connected to the controller for positional control of the cam to control the pivot position of the arm.

Figure 4A:
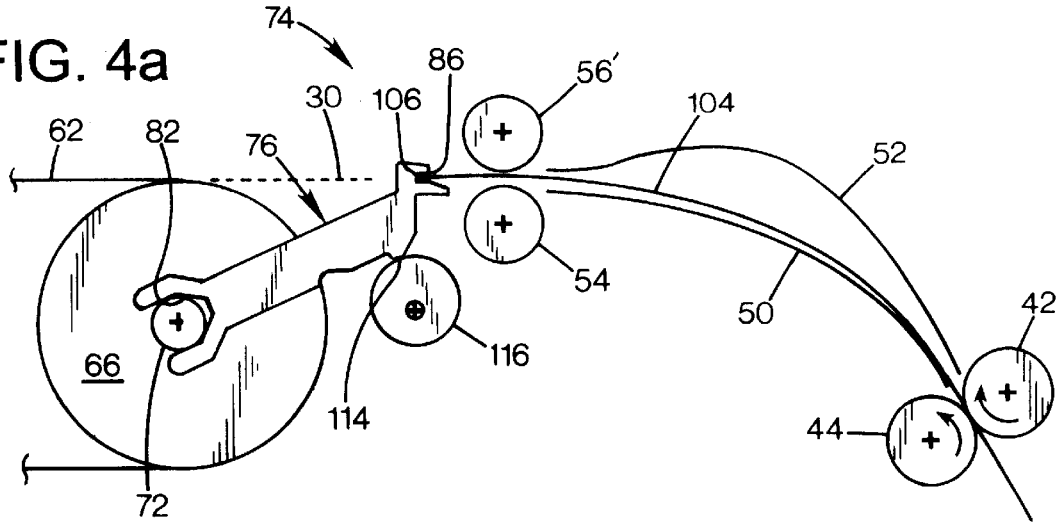
FIGS. 4*a*–4*e* illustrate a sequence of operation in the preferred embodiment.

FIGS. 4*a*–4*e* show a sequence of operation of the alignment mechanism 74. In FIG. 4*a*, The arm 76 is pivoted upward to an elevated position by cam 116 so that the groove 86 intercepts the media path 30. Roller 56' is in an elevated position to provide a clearance gap with roller 54. Rollers 42 and 44 are positioned together to define a nip. The media sheet 104 is being driven by the rotating feed rollers 42, 44, and its leading edge 106 has just encountered the groove floor 102. Assuming that the sheet is skewed, only one corner of the leading edge has bottomed out against the groove floor.

Figure 4B:
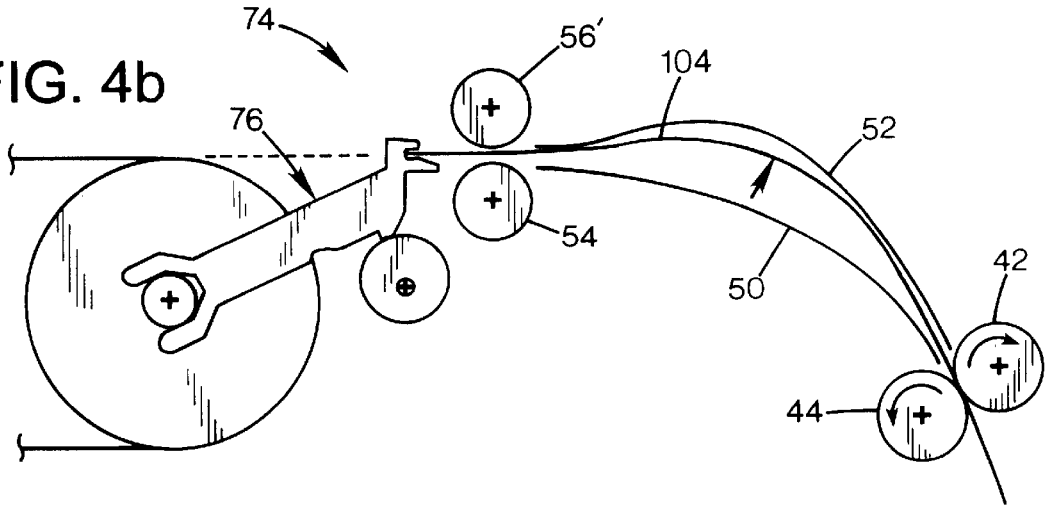

In FIG. 4*b*, the feed wheels continue to rotate, causing the sheet to buckle upward toward guide 52. As the sheet buckles, the entire leading edge bottoms out against the groove floor 102. The lateral edge of the sheet associated with the first corner buckles more than the opposite edge. In spite of the skew maintained between rollers 42 and 44, the leading edge of the sheet is positively aligned in the groove. The buckling of the sheet is limited to a single gentle arc, and by the limited distance of the groove to the gap defined between rollers 54 and 56' relative to the long distance between the rollers 54, 56 and the feed rollers 42, 44. In the preferred embodiment, the distance from the groove to the rollers 54, 56 should be minimized, but depends on the diameter of the rollers, with larger rollers requiring greater distance. The distance from the rollers 54, 56 to rollers 42, 44 is about 5 inches, to accommodate 4 by 6 inch index cards as the minimum media length. This ensures that an essentially straight, minimally buckled leading segment of the sheet extends between the groove and the rollers 54, 56, as a large radius single buckle between the guides will limit the amount of buckle in the leading edge segment.

Figure 4C:
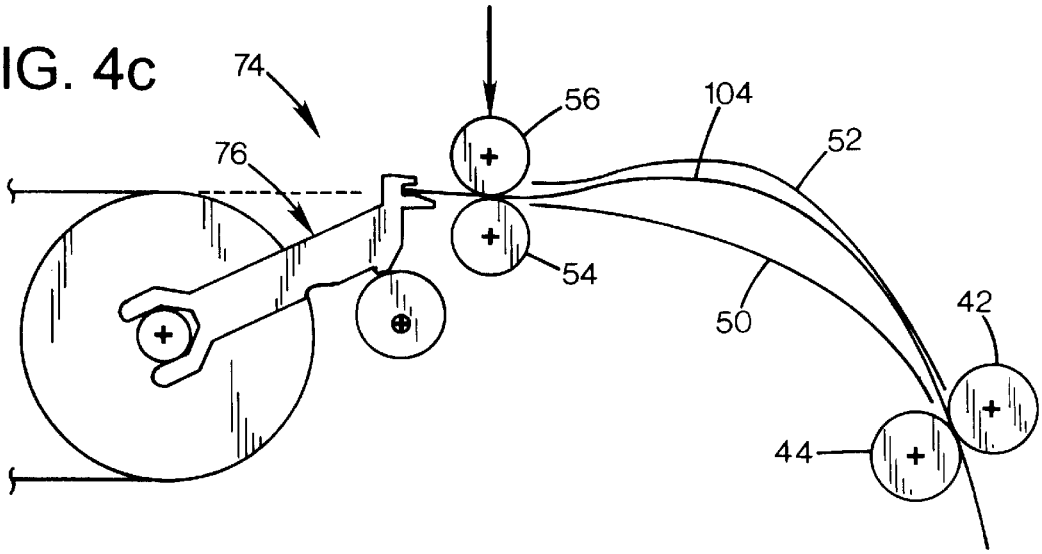

In FIG. 4*c*, the rollers 42, 44 have stopped rotating before the sheet has reached the upper guide 52. This ensures that the buckle in the sheet is a single order arc of large radius, as discussed above. After rolling stops, the roller 56 moves to the closed position to capture the leading portion of the sheet in the nip, while the entire length of the leading edge remains firmly pressed into the groove. The sheet alignment established by the groove is now preserved by the rollers 54, 56.

Figure 4D:
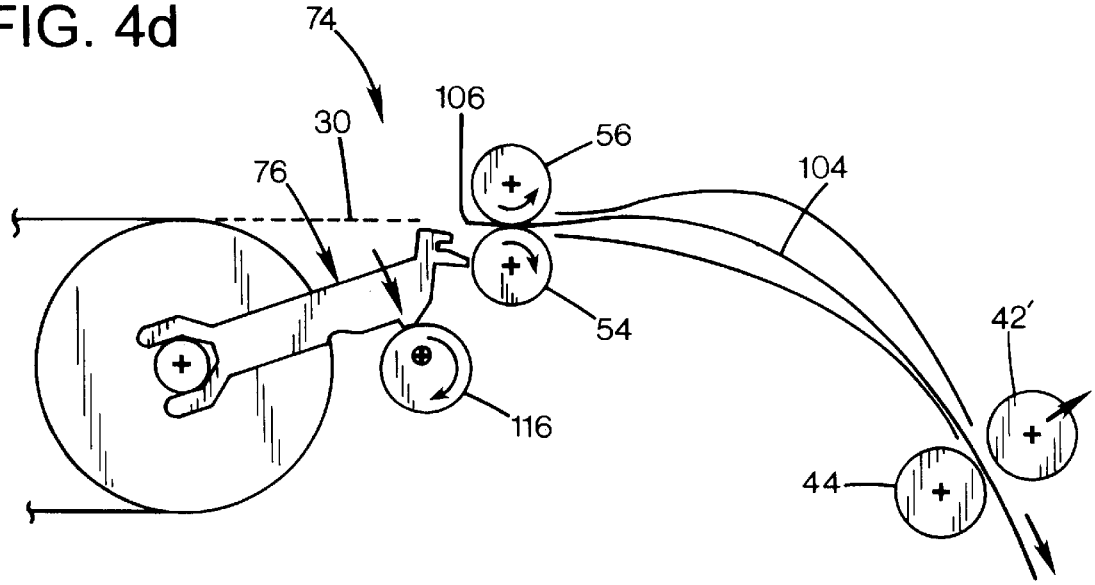
Figure 4E:
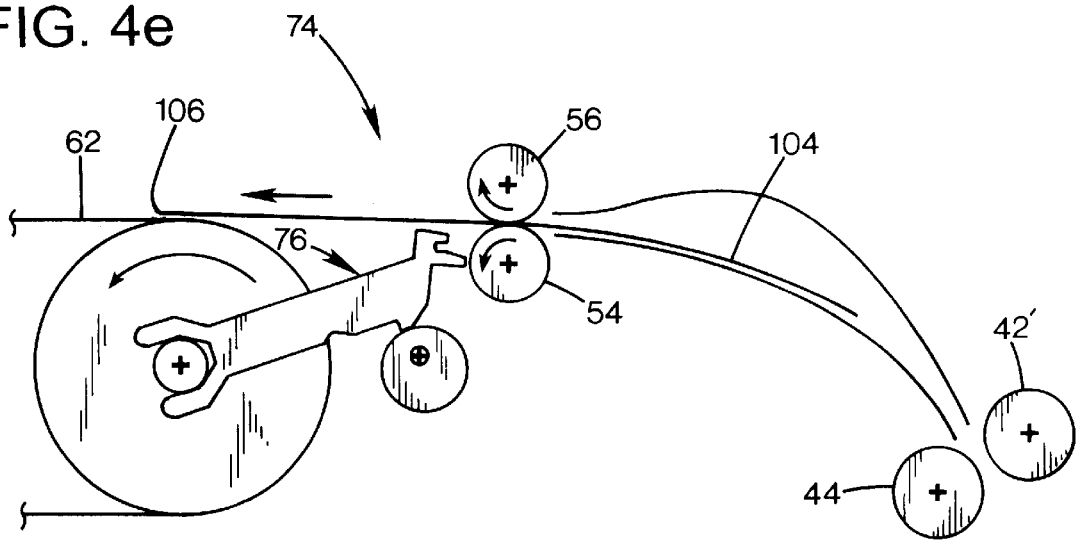

In FIG. 4*d*, the lower feed rollers 42, 44 are opened, and the trailing edge of the sheet is free to extend back through the gap as the force of the sheet buckle releases. The upper rollers 54, 56 rotate to drive the sheet rearward, clear of the alignment element. When the leading edge is clear, the cam 116 is rotated to allow the arm 76 to pivot downward, clear of the media path 30. Then, as shown in FIG. 4*e*, feeding of the aligned sheet may proceed by rotating the rollers 54 56 to drive the sheet along the paper path toward the belt 62. Before the entire sheet clears rollers 54, 56, it is secured to the belt by any conventional means for maintaining alignment while printing.

While the above is discussed in terms of preferred and alternative embodiments, the invention is not intended to be so limited.

What is claimed is:

1. A printer comprising:

a media transport mechanism defining a media path that extends from a media supply and past a print engine;

a media alignment element movable between an extended position intersecting the path between the supply and the engine and a retracted position away from the path, wherein the media alignment element is configured to de-skew print media for a print engine that will generate an image on the media; and a controller operable to control the media transport mechanism so as to advance a media sheet into contact with the alignment element when the alignment element is in the extended position and then withdraw the media sheet from the alignment element, the controller further being operable to then move the alignment element to the retracted position.

2. The printer of claim 1 including a first pair of rollers between the supply and the alignment element and encompassing the path.

3. The printer of claim 2 wherein the first rollers are movable between a spaced apart open position and a closed position defining a nip.

4. The printer of claim 3 wherein the controller is operable to position the first rollers in the open position and the alignment element in the extended position, the controller further being operable to close the first roller pair prior to moving the alignment element to the retracted position.

5. The printer of claim 4 wherein the controller is operable to move the sheet away from the alignment element after closing the first rollers.

6. The printer of claim 2 including a second pair of rollers between the first rollers and the media supply and encompassing the media path.

7. The printer of claim 6 wherein the first roller pair defines a first nip plane, and the second roller pair defines a second nip plane offset from the first nip plane.

8. The printer of claim 2 wherein the alignment element is adjacent the first roller pair.

9. The printer of claim 1 wherein the alignment element defines a channel encompassing the media path.

10. The printer of claim 9, wherein the channel has opposed walls spaced apart by a limited distance, and a floor, such that a sheet abuts the floor for alignment, and the walls limit buckling of a leading sheet portion in the channel.

11. The printer of claim 1 wherein the transport mechanism includes a datum shaft operably connected to a media transport surface operable to engage a media sheet during printing.

12. The printer of claim 11 wherein the alignment mechanism is registered to the datum shaft.

13. The printer of claim 12 wherein the alignment mechanism has a first end receiving the datum shaft, and an opposed end defining a media contact surface.

14. The printer of claim 1 wherein the alignment mechanism is pivotally connected to a portion of the transport mechanism.

15. A method of aligning media in a printer comprising:

moving a leading edge of a media sheet into contact with an alignment element;

gripping a portion of the sheet while the leading edge is in contact with the alignment element;

moving the alignment element such that the sheet may proceed without contacting the alignment element; and while gripping, feeding the media toward a print engine for printing.

16. The method of claim 15 wherein gripping includes closing a roller pair on the sheet, and feeding includes rotating the rollers.

17. The method of claim 15 wherein gripping includes gripping a portion of the sheet proximate the leading edge.

18. The method of claim 15 wherein moving a leading edge of a media sheet into contact with an alignment element includes buckling the sheet.

19. The method of claim 15 including moving at least one of the sheet and the alignment element after gripping.

20. The method of claim 15, including moving the sheet away from the alignment element after gripping and before moving the alignment element, such that the sheet may proceed without contacting the alignment element.

21. A printer comprising:

a media transport mechanism defining a media path that extends from a media supply to a print engine; and a media alignment element movable between an extended position intersecting path between the supply and the engine and a retracted position outside the path; and a channel formed along the length of the alignment element.

22. The printer of claim 21, including a first pair of rollers positioned between the supply and the alignment element.

23. The printer of claim 22, wherein the first pair of rollers is movable between an open position and a closed position defining a nip.

24. The printer of claim 23, including a second pair of rollers positioned between the first pair of rollers and the media supply, wherein the first pair of rollers is positioned between the alignment element and the second pair of rollers.

25. The printer of claim 24, including a controller operable to position the first pair of rollers in the open position and the alignment element in the extended position.

26. The printer of claim 25, wherein the controller is further operable to close the second pair of rollers and to drive the second pair of rollers to advance a media sheet into the channel of the alignment element.

27. The printer of claim 26, wherein the controller is further operable to position the first pair of rollers in the closed position after the media sheet is advanced into the alignment element.

28. The printer of claim 27, wherein the controller is further operable to position the second pair of rollers in the open position after closing the first pair of rollers.

29. The printer of claim 28, wherein the controller is further operable to drive the first pair of rollers to retract the sheet along the path away from the alignment element after closing the first pair of rollers.

30. The printer of claim 29, wherein the controller is further operable to move the alignment element to the retracted position.

31. The printer of claim 21, wherein the channel has opposed walls spaced apart by a limited distance, and a floor, such that a sheet abuts the floor for alignment, and the walls limit buckling of a leading sheet portion in the channel.

32. The printer of claim 21, wherein the transport mechanism includes a datum shaft operably connected to a media transport surface operable to engage a media sheet during printing.

33. The printer of claim 32, wherein the alignment element is registered to the datum shaft.

34. The printer of claim 33, wherein the alignment element has a first end configured to receive the datum shaft, and an opposed end defining a media contact surface.

35. The printer of claim 21, wherein the alignment element is pivotally connected to a portion of the transport mechanism.

36. A printer comprising:

a media transport mechanism defining a media path that extends from a media supply and past a print engine; and a media alignment element that defines a channel, the media alignment element being movable between an extended position in which the channel intersects the path between the supply and the engine and a retracted position away from the path, wherein the media alignment element is configured to de-skew the print media for a print engine that will generate an image on the media.

37. A printer comprising:

a media transport mechanism defining a media path that extends from a media supply and past a print engine, the transport mechanism including a datum shaft operably connected to a media transport surface operable to engage a media sheet during printing; and a media alignment element movable between an extended position intersecting the path between the supply and the engine and a retracted position away from the path, wherein the media alignment element is configured to de-skew the print media for a print engine that will generate an image on the media.

38. A method of aligning media comprising:

moving a leading edge of a media sheet along a media path into contract with an alignment element;

gripping a portion of the sheet while the leading edge is in contact with the alignment element;

retracting the sheet away from the alignment element;

moving the alignment element out of the media path; and advancing the media along the media path past the alignment element.

* * * * *

UNITED STATES PATENT AND TRADEMARK OFFICE

CERTIFICATE OF CORRECTION

PATENT NO. : 6,585,439 B2
DATED : July 1, 2003
INVENTOR(S) : Bruce G. Johnson et al.

It is certified that error appears in the above-identified patent and that said Letters Patent is hereby corrected as shown below:

Column 4,
Line 55, delete “a media” and insert therefor -- the media --.
Line 62, delete “mecha-” and insert therefor -- element --.
Line 63, delete “nism”.

Column 5,
Line 26, after “intersecting” insert -- the --.
Line 28, delete “along the length” and insert therefor -- along a length --.
Line 52, delete “in the” and insert therefor -- in an --.

Column 6,
Lines 31 and 44, delete “the print” and insert therefor -- a print --.
Line 48, delete “contract” and insert therefor -- contact --.
Line 54, delete “media along” and insert therefor -- media sheet along --.

Signed and Sealed this

Thirtieth Day of August, 2005

JON W. DUDAS
*Director of the United States Patent and Trademark Office*